US011757204B2

(12) United States Patent
Novak et al.

(10) Patent No.: US 11,757,204 B2
(45) Date of Patent: Sep. 12, 2023

(54) SINGLE SUBSTRATE ULTRA-WIDEBAND ANTENNA AND ANTENNA ARRAY

(71) Applicants: Futurewei Technologies, Inc., Plano, TX (US); Novaa Ltd., Columbus, OH (US)

(72) Inventors: Markus Novak, Dublin, OH (US); Ahmed Hassan Abdelaziz Abdelrahman, Cary, NC (US); Zhengxiang Ma, Summit, NJ (US); Munawar Kermalli, Morris Plains, NJ (US); Leonard Piazzi, Denville, NJ (US)

(73) Assignees: Futurewei Technologies, Inc., Plano, TX (US); Novaa Ltd., Columbus, OH (US)

( * ) Notice: Subject to any disclaimer, the term of this patent is extended or adjusted under 35 U.S.C. 154(b) by 0 days.

(21) Appl. No.: 17/677,261

(22) Filed: Feb. 22, 2022

(65) Prior Publication Data

US 2022/0181790 A1 Jun. 9, 2022

Related U.S. Application Data

(63) Continuation of application No. PCT/US2019/047702, filed on Aug. 22, 2019.

(51) Int. Cl.
*H01Q 21/00* (2006.01)
*H01Q 5/314* (2015.01)
(Continued)

(52) U.S. Cl.
CPC ..... *H01Q 21/0043* (2013.01); *H01Q 1/424* (2013.01); *H01Q 5/25* (2015.01); *H01Q 5/314* (2015.01)

(58) Field of Classification Search
CPC ..... H01Q 21/0043; H01Q 1/424; H01Q 5/25; H01Q 5/314; H01Q 9/285; H01Q 21/064; H01Q 21/26; H01Q 1/48
See application file for complete search history.

(56) References Cited

U.S. PATENT DOCUMENTS 10,320,088 B1 * 6/2019 Johnson ..... H01Q 21/062
2022/0200159 A1 * 6/2022 Abdelrahman .... H01Q 21/0025
(Continued)

FOREIGN PATENT DOCUMENTS

CN 103531895 B * 1/2017
CN 108511914 A * 9/2018 ..... H01Q 1/38
(Continued)

OTHER PUBLICATIONS

Novak, Markus H., et al., "Ultrawideband Antennas for Multiband Satellite Communications at UHF-Ku Frequencies," IEEE Transactions on Antennas and Propagation, vol. 63, No. 4, Apr. 3, 2015, 8 pages.

*Primary Examiner* — Vibol Tan
(74) *Attorney, Agent, or Firm* — Slater Matsil, LLP

(57) ABSTRACT

A modular wideband antenna includes a ground plane, first and second antenna elements disposed on a first surface of a substrate, a first portion of a two-layer feed balun disposed on the first surface of the substrate, and electrically coupled to the first and second antenna elements, and to the ground plane, a second portion of the two-layer feed balun disposed on a second surface of the substrate, the second portion of the two-layer feed balun being electrically coupled to a signal feed, and being capacitively coupled to the first portion of the two-layer feed balun, first and second coupling capacitances disposed on the second surface of the substrate, the first coupling capacitance being capacitively coupled to the first antenna element, and the second coupling capacitance being capacitively coupled to the second
(Continued)

antenna element, and first and second grounding posts being electrically coupled to the first and second coupling capacitances.

22 Claims, 10 Drawing Sheets

(51) Int. Cl.
*H01Q 5/25* (2015.01)
*H01Q 1/42* (2006.01)

(56) References Cited

U.S. PATENT DOCUMENTS

| | | | | |
|---|---|---|---|---|
| 2022/0271438 | A1* | 8/2022 | Livadaru | H01Q 9/285 |
| 2022/0328968 | A1* | 10/2022 | Johnson | H01Q 9/16 |

FOREIGN PATENT DOCUMENTS

| | | | | | |
|---|---|---|---|---|---|
| CN | 111370860 | A | * | 7/2020 | |
| EP | 2575210 | A1 | | 4/2013 | |
| WO | 2006079993 | A1 | | 8/2006 | |
| WO | WO-2006079993 | A1 | * | 8/2006 | H01Q 21/0006 |
| WO | WO-2020106344 | A2 | * | 5/2020 | H01Q 1/38 |

* cited by examiner

SINGLE SUBSTRATE ULTRA-WIDEBAND ANTENNA AND ANTENNA ARRAY

CROSS-REFERENCE TO RELATED APPLICATIONS

This application is a continuation of and claims the benefit of priority to PCT Application Number PCT/US2019/047702 filed on Aug. 22, 2019, entitled "Single-Substrate Ultra-Wideband Antenna and Antenna Array," which application is hereby incorporated by reference herein in its entirety.

TECHNICAL FIELD

The present disclosure relates generally to antennas, and, in particular embodiments, to single substrate ultra-wideband (UWB) antenna and antenna array.

BACKGROUND

Tightly coupled arrays (TCAs) are low profile antenna arrays that have demonstrated ultra-wideband (UWB) capability. TCAs are based on extending the effective length of the array elements through strong mutual coupling with neighbor elements, which in turn can imitate the conventional element lengths required for low frequency bands. TCAs are good candidates for commercial sub-6 gigahertz (GHz) Fifth Generation (5G) applications, where single antenna architectures that cover the bandwidth from 700 megahertz (MHz) to 6 GHz (an 8.6:1 bandwidth ratio) have been proposed.

The design of UWB antennas is complex and requires specific techniques to overcome challenges, such as a need for an UWB balanced feed, to avoid spurious mode generation, to maintain antenna impedance matching when beam scanning, to keep cross coupling low between antenna radiation patterns (where the wide-angle scanning of phased arrays causes severe de-tuning and impedance mismatch, preventing practical application), and so on. Commonly available designs are not feasible for low-cost, high-volume commercial applications, as will be required for 5G wireless networks.

Therefore, there is a need for novel antenna and antenna array designs that overcome the design challenges and maintains the required specifications, as well as feature reduced design complexity to achieve low fabrication costs and small dimensions to enable small, lightweight commercial products.

SUMMARY

According to a first aspect, a modular wideband antenna is presented. The modular wideband antenna comprising a ground plane, a first antenna element and a second antenna element disposed on a first surface of a substrate, and a first portion of a two-layer feed balun disposed on the first surface of the substrate, the first portion of the feed balun being electrically coupled to the first and second antenna elements, and the first portion of the feed balun being electrically coupled to the ground plane. The modular wideband antenna further comprising a second portion of the two-layer feed balun disposed on a second surface of the substrate, the second portion of two-layer the feed balun being electrically coupled to a signal feed, and the second portion of two-layer the feed balun being capacitively coupled to the first portion of the two-layer feed balun, a first coupling capacitance and a second coupling capacitance disposed on the second surface of the substrate, the first coupling capacitance being capacitively coupled to the first antenna element, and the second coupling capacitance being capacitively coupled to the second antenna element, and a first grounding post and a second grounding post, the first grounding post being electrically coupled to the first coupling capacitance and the ground plane, the second grounding post being electrically coupled to the second coupling capacitance and the ground plane.

In a first implementation form of the modular wideband antenna according to the first aspect as such, the first portion of the feed balun comprises a first conductor and a second conductor, the first conductor being electrically coupled to the first antenna element and the ground plane, and the second conductor being electrically coupled to the second antenna element and the ground plane.

In a second implementation form of the modular wideband antenna according to the first aspect as such or any preceding implementation form of the first aspect, the first conductor and the second conductor are separated by a gap.

In a third implementation form of the modular wideband antenna according to the first aspect as such or any preceding implementation form of the first aspect, the first conductor and the second conductor are of substantially constant width.

In a fourth implementation form of the modular wideband antenna according to the first aspect as such or any preceding implementation form of the first aspect, the first conductor and the second conductor are of substantially equal width.

In a fifth implementation form of the modular wideband antenna according to the first aspect as such or any preceding implementation form of the first aspect, the second portion of the two-layer feed balun comprising a tapered first portion electrically coupled to the signal feed, a curved second portion electrically coupled to the tapered first portion, a curved third portion electrically coupled to the curved second portion, and a rectangular fourth portion electrically coupled to the curved third portion.

In a sixth implementation form of the modular wideband antenna according to the first aspect as such or any preceding implementation form of the first aspect, the first portion of the two-layer feed balun, the first antenna element, and the second antenna element comprise a first metallization layer.

In a seventh implementation form of the modular wideband antenna according to the first aspect as such or any preceding implementation form of the first aspect, the second portion of the two-layer feed balun, the first coupling capacitance, and the second coupling capacitance comprise a second metallization layer.

In an eighth implementation form of the modular wideband antenna according to the first aspect as such or any preceding implementation form of the first aspect, the second metallization layer further comprising the first grounding post and the second grounding post.

In a ninth implementation form of the modular wideband antenna according to the first aspect as such or any preceding implementation form of the first aspect, the substrate being a single layer substrate.

According to a second aspect, an antenna array is provided. The antenna array comprising a ground plane, and a plurality of modular wideband antennas. Each modular wideband antenna comprising, a first antenna element and a second antenna element disposed on a first surface of a substrate, a first portion of a two-layer feed balun disposed on the first surface of the substrate, the first portion of the two-layer feed balun being electrically coupled to the first and second antenna elements, and the first portion of the two-layer feed balun being electrically coupled to the ground plane, a second portion of the two-layer feed balun disposed on a second surface of the substrate, the second portion of the two-layer feed balun being electrically coupled to a signal feed, and the second portion of the two-layer feed balun being capacitively coupled to the first portion of the two-layer feed balun, and a first coupling capacitance and a second coupling capacitance disposed on the second surface of the substrate, the first coupling capacitance being capacitively coupled to the first antenna element, and the second coupling capacitance being capacitively coupled to the second antenna element.

In a first implementation form of the antenna array according to the second aspect as such, each modular wideband antenna further comprising a first grounding post and a second grounding post, the first grounding post being electrically coupled to the first coupling capacitance and the ground plane, the second grounding post being electrically coupled to the second coupling capacitance and the ground plane.

In a second implementation form of the antenna array according to the second aspect as such or any preceding implementation form of the second aspect, the antenna array comprising a single polarized array, and the first antenna elements and the second antenna elements being arranged in a plurality of parallel planes.

In a third implementation form of the antenna array according to the second aspect as such or any preceding implementation form of the second aspect, the antenna array comprising a dual polarized array, the first antenna elements and the second antenna elements of a first subset of the plurality of modular wideband antenna elements being arranged in a plurality of first parallel planes, and the first antenna elements and the second antenna elements of a second subset of the plurality of modular wideband antenna elements being arranged in a plurality of second parallel planes.

In a fourth implementation form of the antenna array according to the second aspect as such or any preceding implementation form of the second aspect, the first parallel planes and the second parallel planes being orthogonal.

In a fifth implementation form of the antenna array according to the second aspect as such or any preceding implementation form of the second aspect, the first grounding posts of the first subset of the plurality of modular wideband antenna elements being electrically coupled to the second grounding posts of the first subset of the plurality of modular wideband antenna elements, and the first grounding posts of the second subset of the plurality of modular wideband antenna elements being electrically coupled to the second grounding posts of the second subset of the plurality of modular wideband antenna elements.

In a sixth implementation form of the antenna array according to the second aspect as such or any preceding implementation form of the second aspect, the first grounding posts and the second grounding posts of the first subset of the plurality of modular wideband antenna elements being electrically coupled to the first grounding posts and the second grounding posts of the second subset of the plurality of modular wideband antenna elements.

In a seventh implementation form of the antenna array according to the second aspect as such or any preceding implementation form of the second aspect, the first grounding posts and the second grounding posts of the first subset of the plurality of modular wideband antenna elements being electrically decoupled from the first grounding posts and the second the of the second subset of the plurality of modular wideband antenna elements.

In an eighth implementation form of the antenna array according to the second aspect as such or any preceding implementation form of the second aspect, the substrate being a single layer substrate.

In a ninth implementation form of the antenna array according to the second aspect as such or any preceding implementation form of the second aspect, further comprising a metasurface or a superstrate disposed over the plurality of modular wideband antenna elements.

In a tenth implementation form of the antenna array according to the second aspect as such or any preceding implementation form of the second aspect, orientations of the substrates of the plurality of modular wideband antennas being diagonal to an orientation of the antenna array.

In an eleventh implementation form of the antenna array according to the second aspect as such or any preceding implementation form of the second aspect, the antenna array being fabricated using a three-dimensional printing process.

An advantage of a preferred embodiment is that the antenna is implementable on a single substrate, therefore, the antenna is simple to manufacture and is low cost. The antenna and antenna array are low profile and small size, to enable small, lightweight commercial products.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION OF ILLUSTRATIVE EMBODIMENTS

The specific embodiments discussed below are merely illustrative of specific embodiments, and are not intended to limit the scope of the disclosure or appended claims.

Figure 1:
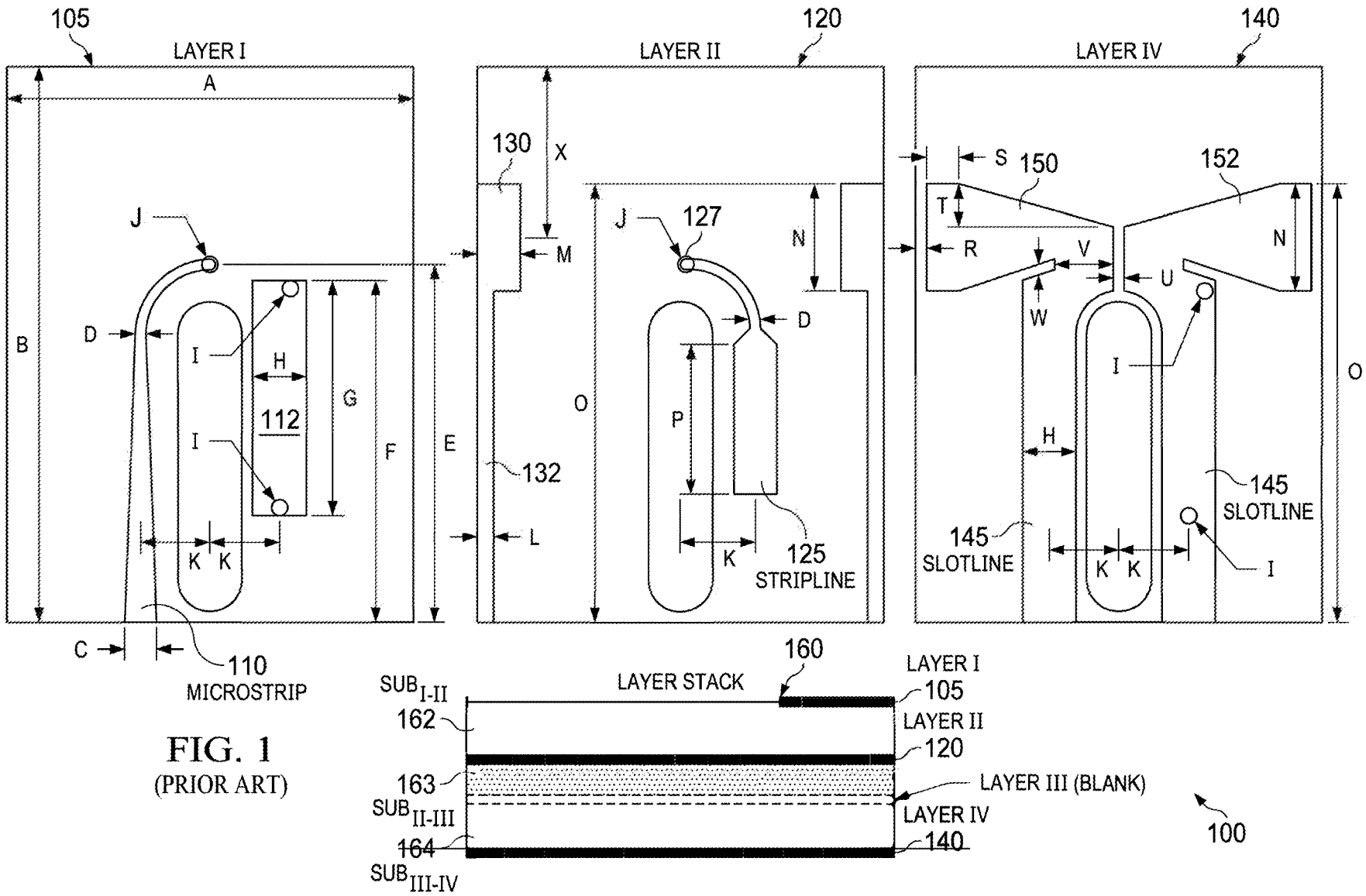
FIG. 1 (PRIOR ART)
FIG. 1 illustrates layers of a prior art ultra-wideband (UWB) antenna.

FIG. 1 illustrates layers of a prior art ultra-wideband (UWB) antenna 100. FIG. 1 presents views of layers I ion, II 120, and IV 140, of UWB antenna 100, which is formed on a multilayer substrate. Layers I 105, II 120, and IV 140 are conductive layers formed on substrates, while Layer III—interposed between Layers II 120 and IV 140 is omitted. $Sub_{I-II}$ 162 is the substrate of Layer I 105 and Layer II 120, $Sub_{III-IV}$ 164 is the substrate of Layer IV 140. A glue layer (e.g., a prepreg layer) may be used as the spacing between Layer II 120 and Layer III. The glue layer is shown in FIG. 1 as $Sub_{II-III}$ 163. Disposed on layer I 105 is a microstrip 110 and a coupling capacitance 112. Microstrip 110 and coupling capacitance 112 form a first portion of a feed balun. On layer II 120, a stripline 125 is electrically coupled to microstrip 110 by via 127. Layer II 120 further comprises coupling capacitances (such as coupling capacitance 130) and grounding posts (such as grounding post 132). Grounding posts may also be referred to as shorting posts. Stripline 125 forms a second portion of the feed balun. Layer IV 140 comprises a slotline 145 and a dipole antenna, comprising antenna elements 150 and 152. Slotline 145 forms a third portion of the feed balun. The dipole antenna is capacitively coupled to coupling capacitances of layer II 120. The feed balun of UWB antenna 100 is a three-layer structure with elements on layers I 105, II 120, and IV 140. A layer stack 160 illustrates a cross-sectional view of UWB antenna 100, illustrating the layers of UWB antenna 100.

According to an example embodiment, as described below in connection with FIGS. 2A, 2B, 3A, 3B, and 4, an antenna, with a balanced feed, that is formed on a single layer substrate is presented. The antenna has antenna elements formed on one side of the single layer substrate, with no metallization internal to the single layer substrate. The antenna features grounded posts and coupling capacitances formed on the other side of the single layer substrate to suppress spurious resonance. The balanced feed, e.g., a balun, and the grounded posts collectively avoid common modes within the operating frequency band.

In an embodiment, the antenna features a low profile design with no matching circuitry below the ground plane. The low profile design helps to simplify fabrication and reduce costs.

Figure 2A:
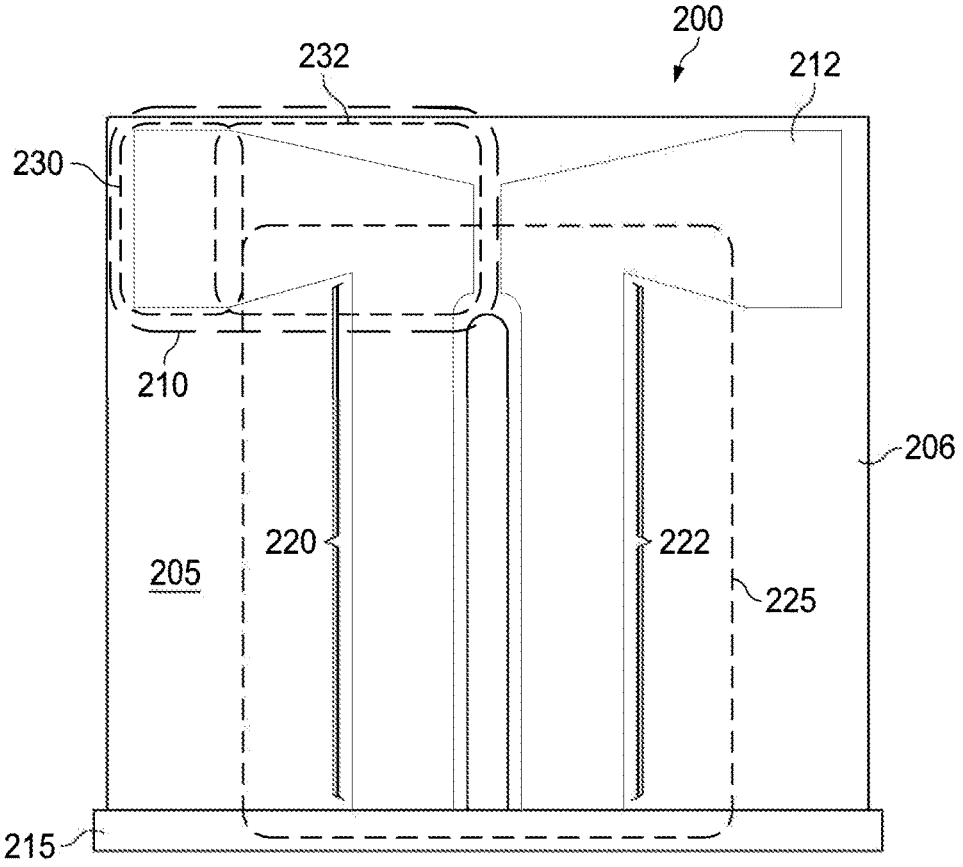
FIG. 2A illustrates a first view of a single layer substrate antenna according to example embodiments presented herein.

FIG. 2A illustrates a first view of a single layer substrate antenna 200 of an example embodiment. The first view displays the components of single layer substrate antenna 200 disposed on a first surface 206 of substrate 205. On the first surface 206 of substrate 205, single layer substrate antenna 200 comprises a first antenna element 210 and a second antenna element 212. First antenna element 210 and second antenna element 212 form a dipole antenna. First antenna element 210 and second antenna element 212 have opposing orientations. First antenna element 210 is electrically coupled to a ground plane 215 by a first connection 220, and second antenna element 212 is electrically coupled to the ground plane 215 by a second connection 222. First connection 220 and second connection 222 collectively form a slot line and is a first portion 225 of a balun for single layer substrate antenna 200.

In an embodiment, first connection 220 and second connection 222 (forming the slot line) are parallel to each other, with a gap present in between first connection 220 and second connection 222. In an embodiment, the gap between first connection 220 and second connection 222 remains substantially constant for the length of first connection 220 and second connection 222. In an embodiment, first connection 220 and second connection 222 have substantially constant width for the entirety of their lengths. In an embodiment, first connection 220 and second connection 222 have substantially equal width for the entirety of their lengths.

In an embodiment, each of first antenna element 210 and second antenna element 212 is comprised of a combination of geometric blocks. As an example, first antenna element 210 includes a rectangular shaped block 230 and a tapered block 232. Tapered block 232 is coupled to first connection 220. In an embodiment, first antenna element 210 and second antenna element 212 are similarly shaped.

Figure 2B:
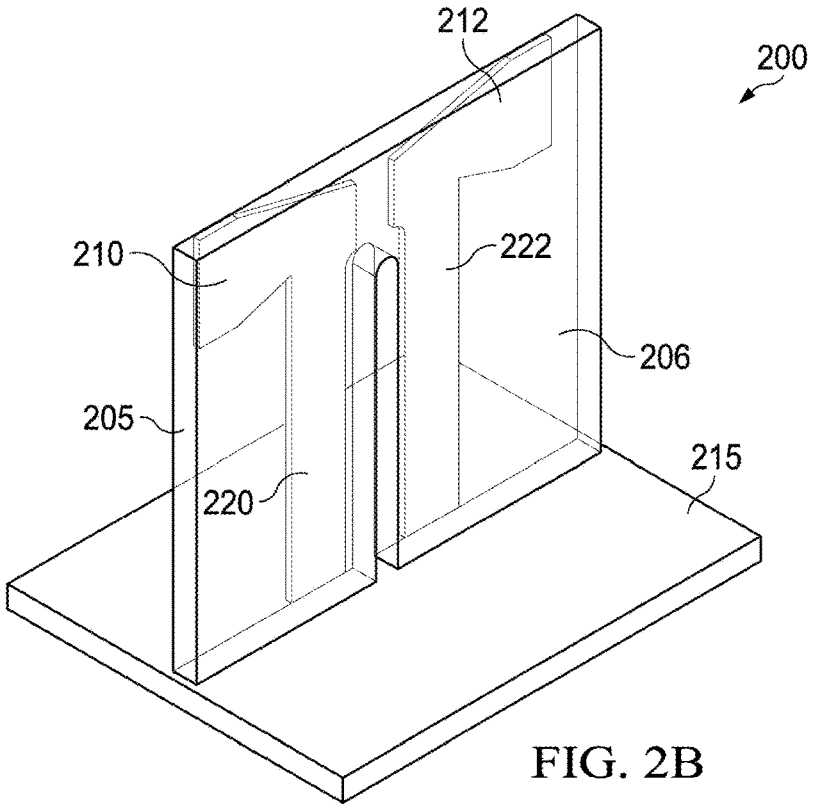
FIG. 2B illustrates an isometric view of single layer substrate antenna, highlighting the first surface of substrate according to example embodiments presented herein.

FIG. 2B illustrates an isometric view of single layer substrate antenna 200, highlighting the first surface 206 of substrate 205. The first surface 206 is the distal surface of substrate 205. As shown in FIG. 2B, first antenna element 210, second antenna element 212, first connection 220, and second connection 222 are all disposed on the first surface 206 of substrate 205. Substrate 205 is, in turn, disposed on ground plane 215.

Figure 3A:
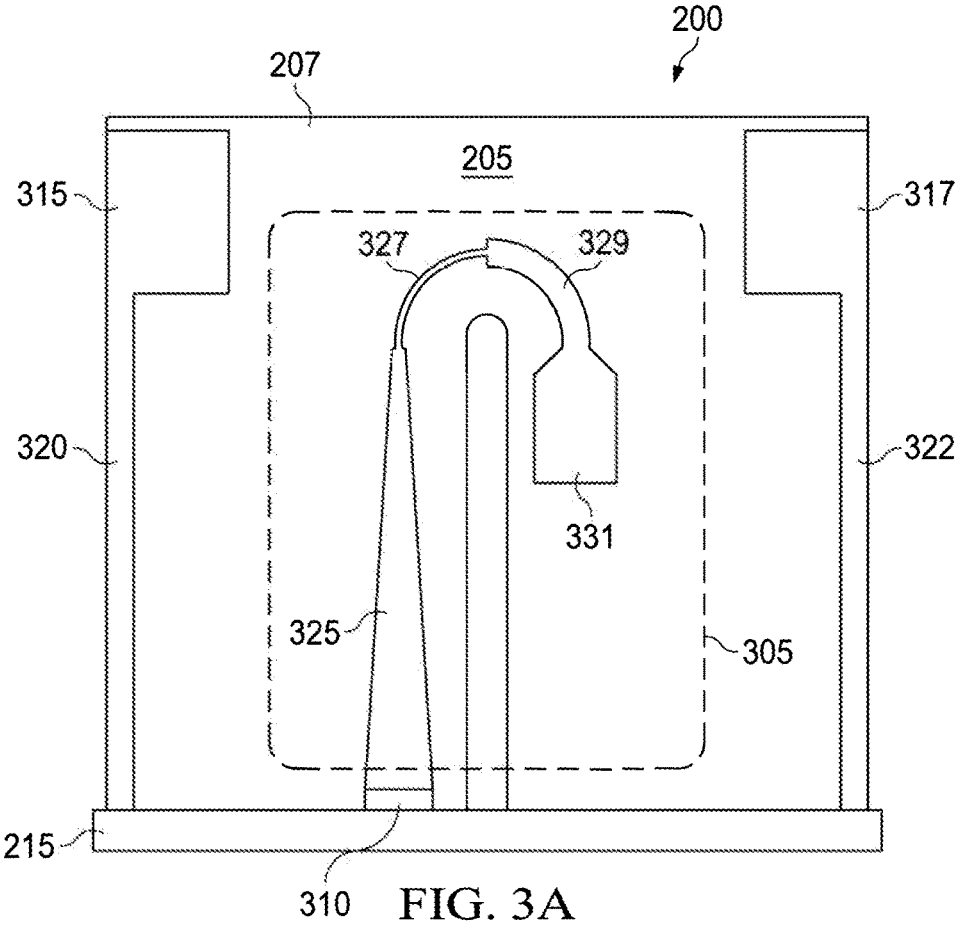
FIG. 3A illustrates a second view of single layer substrate antenna according to example embodiments presented herein.

FIG. 3A illustrates a second view of single layer substrate antenna 200 of an example embodiment. The second view displays the components of single layer substrate antenna 200 disposed on a second surface 207 of substrate 205. The second surface 207 (as shown in FIG. 3A) and the first surface 206 (as shown in FIG. 2A) of substrate 205 are opposite surfaces of substrate 205. As discussed previously, the first surface 206 is the distal surface of substrate 205, while the second surface 207 is the mesial surface of substrate 205. On the second surface 207 of substrate 205, single layer substrate antenna 200 comprises a second portion 305 of the balun for single substrate antenna 200. Second portion 305 of the balun is electrically coupled to signal feed 310. Second portion 305 of the balun is capacitively coupled to first portion 225 of the balun.

The second surface 207 of substrate 205 further comprises a first coupling capacitance 315 that is capacitively coupled to first antenna element 210, and a second coupling capacitance 317 that is capacitively coupled to second antenna element 212. First coupling capacitance 315 is electrically coupled to a first post 320, which is, in turn, electrically coupled to ground plane 215. Similarly, second coupling capacitance 317 is electrically coupled to a second post 322, which is, in turn, electrically coupled to ground plane 215. First post 320 and second post 322 may be referred to as grounding posts or shorting posts.

In an embodiment, second portion 305 of balun comprises a microstrip line and includes a tapered first portion 325, a curved second portion 327, a curved third portion 329, and a rectangular fourth portion 331. Tapered first portion 325 is electrically coupled to signal feed 310, while curved second portion 327 is electrically coupled to tapered first portion 325 and curved third portion 329. Rectangular fourth portion 331 is electrically coupled to curved third portion 329. Although the description of FIGS. 2A and 2B presents the discussion of a particular balun design, the example embodiments presented herein are operable with other balun designs. Therefore, balun design described herein should not be construed as being limiting to the scope or spirit of the example embodiments.

Figure 3B:
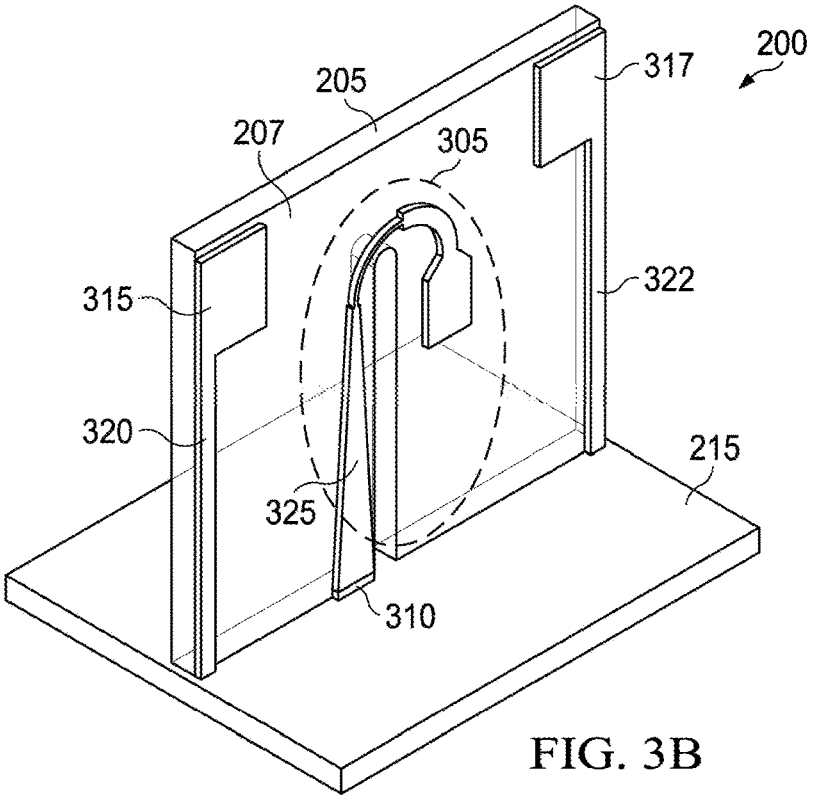
FIG. 3B illustrates an isometric view of single layer substrate antenna, highlighting the second surface of substrate according to example embodiments presented herein.

FIG. 3B illustrates an isometric view of single layer substrate antenna 200, highlighting the second surface 207 of substrate 205. As shown in FIG. 3B, second portion 305 of balun, first coupling capacitance 315, second coupling capacitance 317, first post 320, and second post 322 are all disposed on the second surface 207 of substrate 205. Substrate 205 is, in turn, disposed on ground plane 215.

Figure 4:
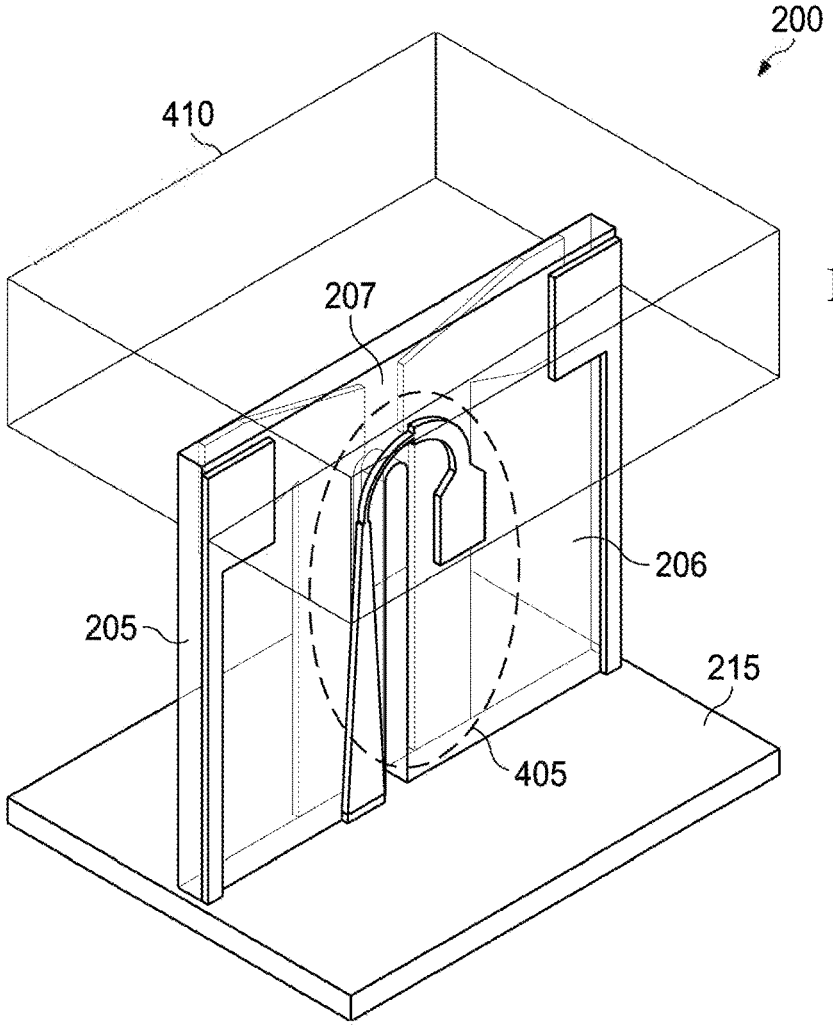
FIG. 4 illustrates an isometric view of single layer substrate antenna, highlighting an example complete implementation of the antenna according to example embodiments presented herein.

FIG. 4 illustrates an isometric view of single layer substrate antenna 200, highlighting an example complete implementation of the antenna. FIG. 4 displays components of single layer substrate antenna 200 present on both surfaces (the first surface 206 and the second surface 207) of substrate 205. As shown in FIG. 4, balun 405 includes first portion 225 and second portion 305, which are on opposite surfaces of substrate 205. Single layer substrate antenna 200 is disposed on ground plane 215. A top surface 410 is disposed on single layer substrate antenna 200. Top surface 410 may be a dielectric superstrate or a metasurface, for example.

In an embodiment, the elements of the single layer substrate antenna, such as the antenna elements, the grounded posts, the coupling capacitances, and the balanced feed are formed from conductive metal, such as low loss metals (including copper, aluminum, etc.).

Figure 5:
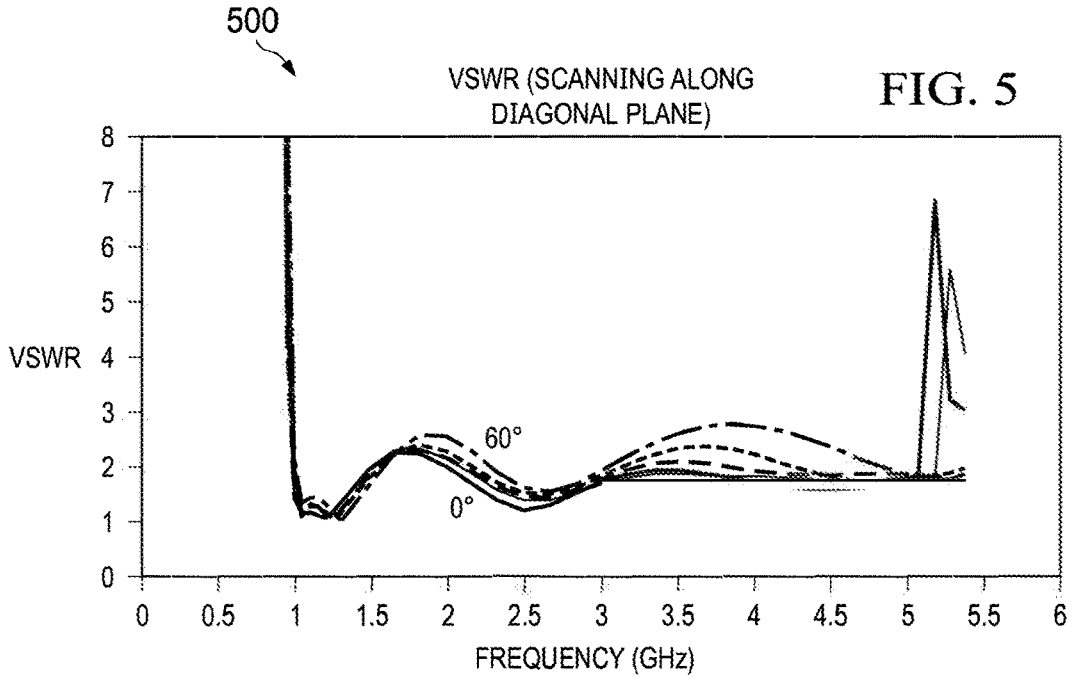
FIG. 5 illustrates a data plot of voltage standing wave ratio (VSWR) versus frequency for the single layer substrate antenna, as shown in FIGS. 2A, 2B, 3A, 3B, and 4 according to example embodiments presented herein.

FIG. 5 illustrates a data plot 500 of voltage standing wave ratio (VSWR) versus frequency for the single layer substrate antenna, as shown in FIGS. 2A, 2B, 3A, 3B, and 4. Data plot 500 displays the VSWR for angles ranging from −60 to +60 degrees with scanning being performed along a diagonal plane, showing that the VSWR for the single layer substrate antenna remains relatively constant from approximately 1.0 GHz to 5.5 GHz for the entirety of the angle range.

According to an example embodiment, as described below in connection with FIGS. 6A, 6B, and 7, an antenna array formed from a plurality of single layer substrate antennas is provided. In an embodiment, the antenna array is a single polarization antenna array. In the single polarization array, the antenna elements of the single layer substrate antennas are arranged in a plurality of parallel planes, for example. In an embodiment, the antenna is a dual polarization antenna array. In the dual polarization array, the antenna elements of a first subset of the plurality of single layer substrate antennas is arranged in a plurality of first parallel planes and then antenna elements of a second subset of the plurality of single layer substrate antennas is arranged in a plurality of second parallel planes, for example. In an embodiment, the first parallel planes and the second parallel planes are orthogonal planes. In an embodiment, the first parallel planes and the second parallel planes are orthogonal planes arranged in a diagonal layout (with respect to the cardinal directions of the antenna array). The diagonal layout helps to stabilize scanning performance, as well as improve impedance behavior between the polarizations at wide scanning angles (e.g., angles greater than 45 degrees).

The design of the single layer substrate antenna enables the easy arrangement of the antennas into antenna arrays. In an embodiment, in a single polarization antenna array, the antennas may be butted end to end and arranged in parallel planes. In an embodiment, in a dual polarization antenna array, a first subset of the antennas may be butted end to end and a second subset of the antennas may be butted end to end, grooves are formed in the substrates so that the substrates may be arranged in an interlocking and orthogonal manner. In an embodiment, the coupling capacitances of the antennas are electrically coupled.

Figure 6A:
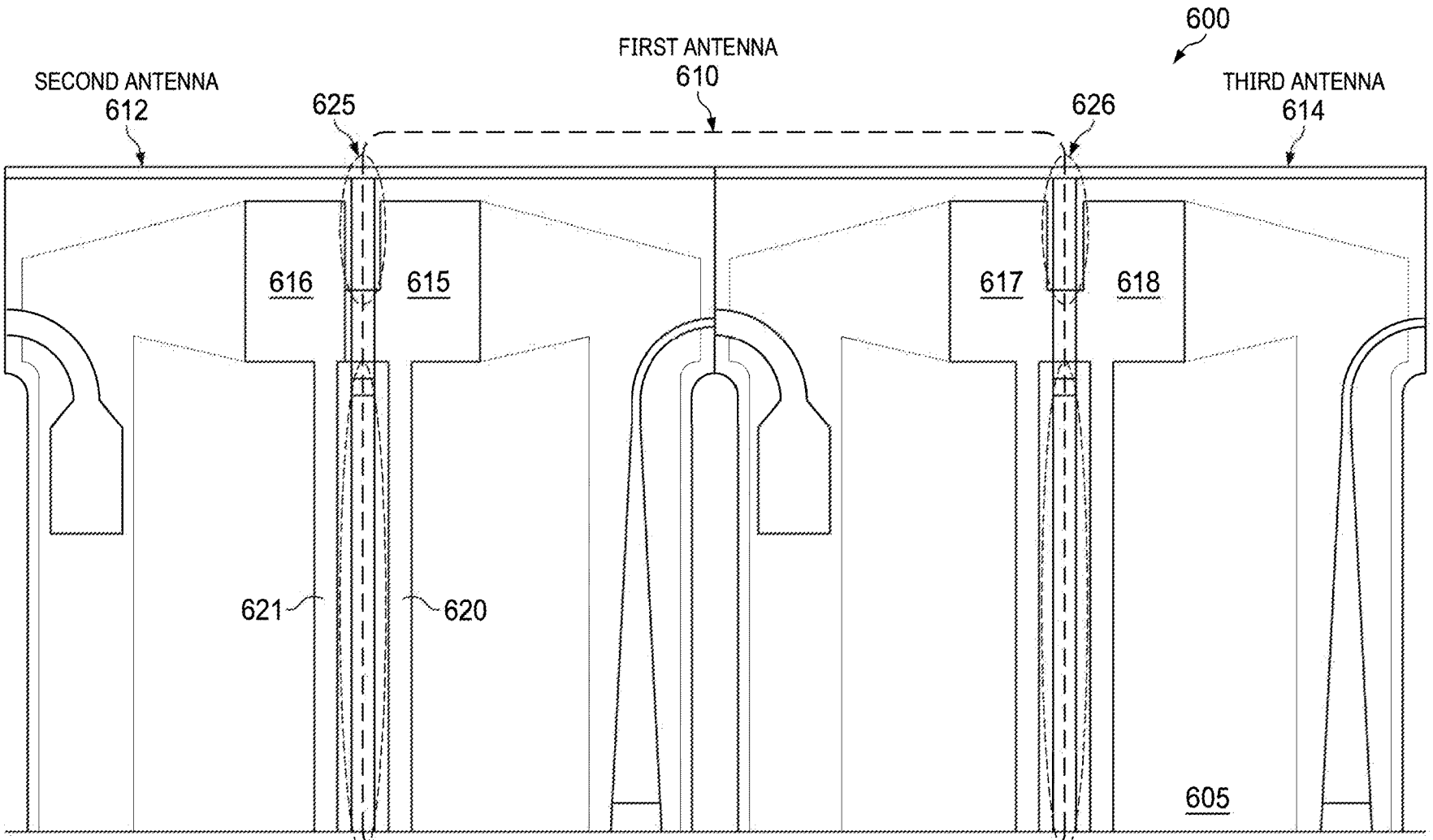
FIG. 6A illustrates a view of a portion of a dual polarization antenna array comprising a first subset of a plurality of single layer substrate antennas arranged in a plurality of first parallel planes according to example embodiments presented herein.

FIG. 6A illustrates a view of a portion of a dual polarization antenna array 600 comprising a first subset of a plurality of single layer substrate antennas arranged in a plurality of first parallel planes. The view of the portion of the dual polarization antenna array 600 presents both surfaces (e.g., opposite surfaces, such as a distal surface and a mesial surface) of substrate 605, displaying antenna elements, coupling capacitances, baluns, and posts present on both surfaces of substrate 605. The view of the portion of the dual polarization antenna array 600 displays a single layer substrate antenna (first antenna 610) in its entirety, and halves of two adjacent single layer substrate antennas (second antenna 612 and third antenna 614).

In an embodiment, the coupling capacitances of adjacent single layer substrate antennas are electrically coupled. For example, first coupling capacitance 615 of first antenna 610 is electrically coupled to second coupling capacitance 616 of second antenna 612, and second coupling capacitance 617 of first antenna 610 is electrically coupled to first coupling capacitance 618 of third antenna. In an embodiment, the coupling capacitances are coupled to the ground plane by posts. As an example, post 620 electrically couples first coupling capacitance 615 of first antenna 610 to the ground plane, while post 621 electrically couples second coupling capacitance 616 of second antenna 612 to the ground plane.

The portion of the dual polarization antenna array 600 includes notches that allow a corresponding portion of dual polarization antenna array comprising a second subset of a plurality of single layer substrate antennas arranged in a plurality of second parallel planes (an example is presented in FIG. 6B) to be fitted into an interlocking and orthogonal manner. As an example, the portion of the dual polarization antenna array 600 includes notches at the top near the antenna elements (e.g., notches 625 and 626) or notches at the bottom near the ground plane (e.g., notches 630 and 631). In practice, portions of the dual polarization antenna array 600 comprising the first subset of single layer substrate antennas will either feature notches located at the top or the bottom, but not both top and bottom. For example, the portions of the dual polarization antenna array 600 comprising the first subset of single layer substrate antennas will feature notches located at the top of the substrate, while the portions of the dual polarization antenna array 650 (presented in FIG. 6B) comprising the second subset of single layer substrate antennas will feature notches located at the bottom of the substrate.

Figure 6B:
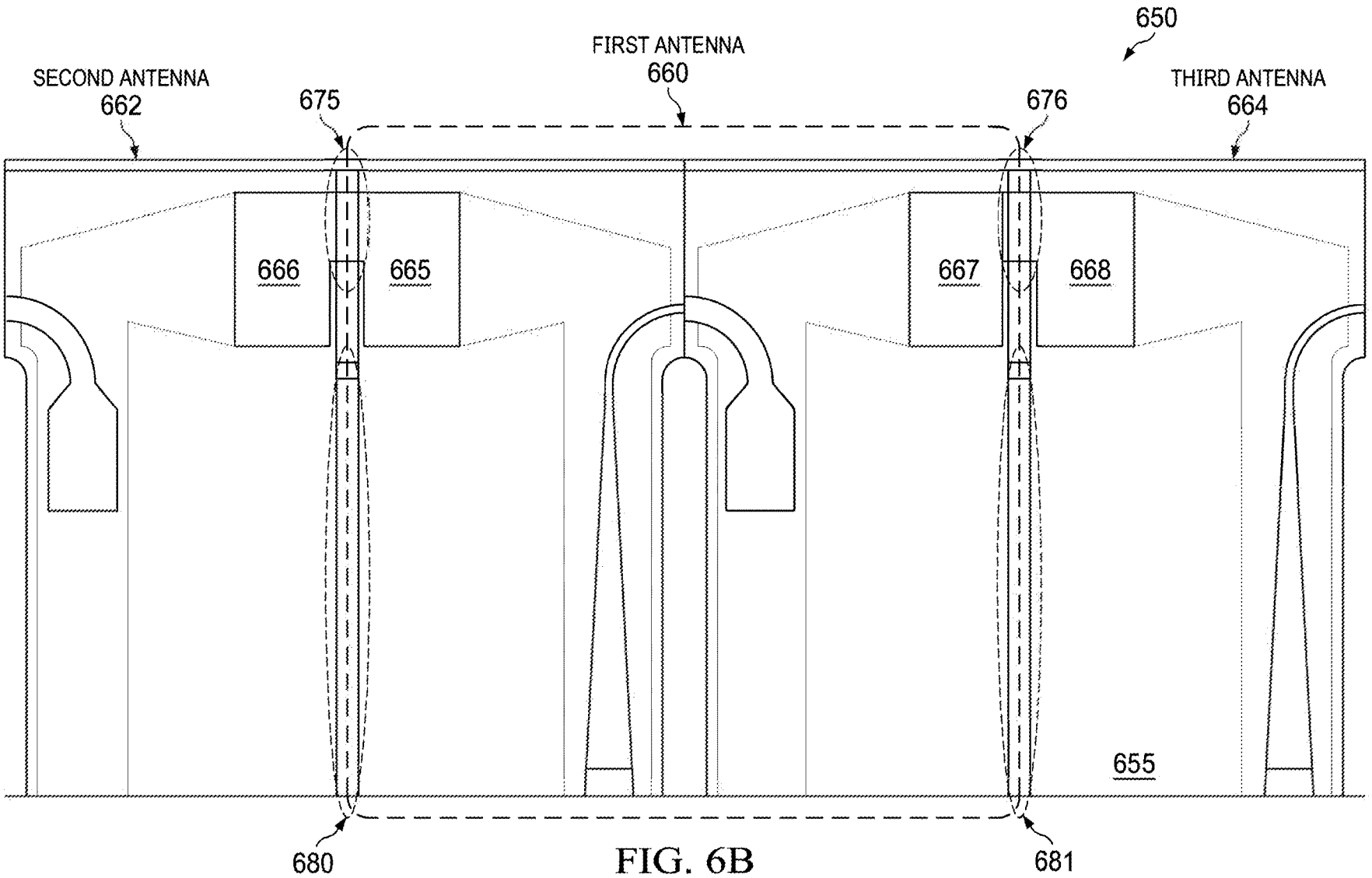
FIG. 6B illustrates a view of a portion of a dual polarization antenna array comprising a second subset of a plurality of single layer substrate antennas arranged in a plurality of second parallel planes according to example embodiments presented herein.

FIG. 6B illustrates a view of a portion of a dual polarization antenna array 650 comprising a second subset of a plurality of single layer substrate antennas arranged in a plurality of second parallel planes. The view of the portion of the dual polarization antenna array 650 presents both surfaces (e.g., opposite surfaces, such as a distal surface and a mesial surface) of substrate 655, displaying antenna elements, coupling capacitances, and baluns present on both surfaces of substrate 655. The view of the portion of the dual polarization antenna array 650 displays a single layer substrate antenna (first antenna 660) in its entirety, and halves of two adjacent single layer substrate antennas (second antenna 662 and third antenna 664).

In an embodiment, the coupling capacitances of adjacent single layer substrate antennas are electrically coupled. For example, first coupling capacitance 665 of first antenna 660 is electrically coupled to second coupling capacitance 666 of second antenna 662, and second coupling capacitance 667 of first antenna 660 is electrically coupled to first coupling capacitance 668 of third antenna. The dual polarization antenna array 650 shown in FIG. 6B does not include posts to couple the coupling capacitances to the ground plane.

The portion of the dual polarization antenna array 650 includes notches that allow a corresponding portion of dual polarization antenna array comprising the first subset of a plurality of single layer substrate antennas arranged in a plurality of first parallel planes (an example is presented in FIG. 6A) to be fitted into an interlocking and orthogonal manner. As an example, the portion of the dual polarization antenna array 650 includes notches at the top near the antenna elements (e.g., notches 675 and 676) or notches at the bottom near the ground plane (e.g., notches 680 and 681). In practice, portions of the dual polarization antenna array 650 comprising the second subset of single layer substrate antennas will either feature notches located at the top or the bottom, but not both top and bottom. For example, the portions of the dual polarization antenna array 650 comprising the second subset of single layer substrate antennas will feature notches located at the bottom of the substrate, while the portions of the dual polarization antenna array 600 comprising the first subset of single layer substrate antennas will feature notches located at the top of the substrate.

Figure 7:
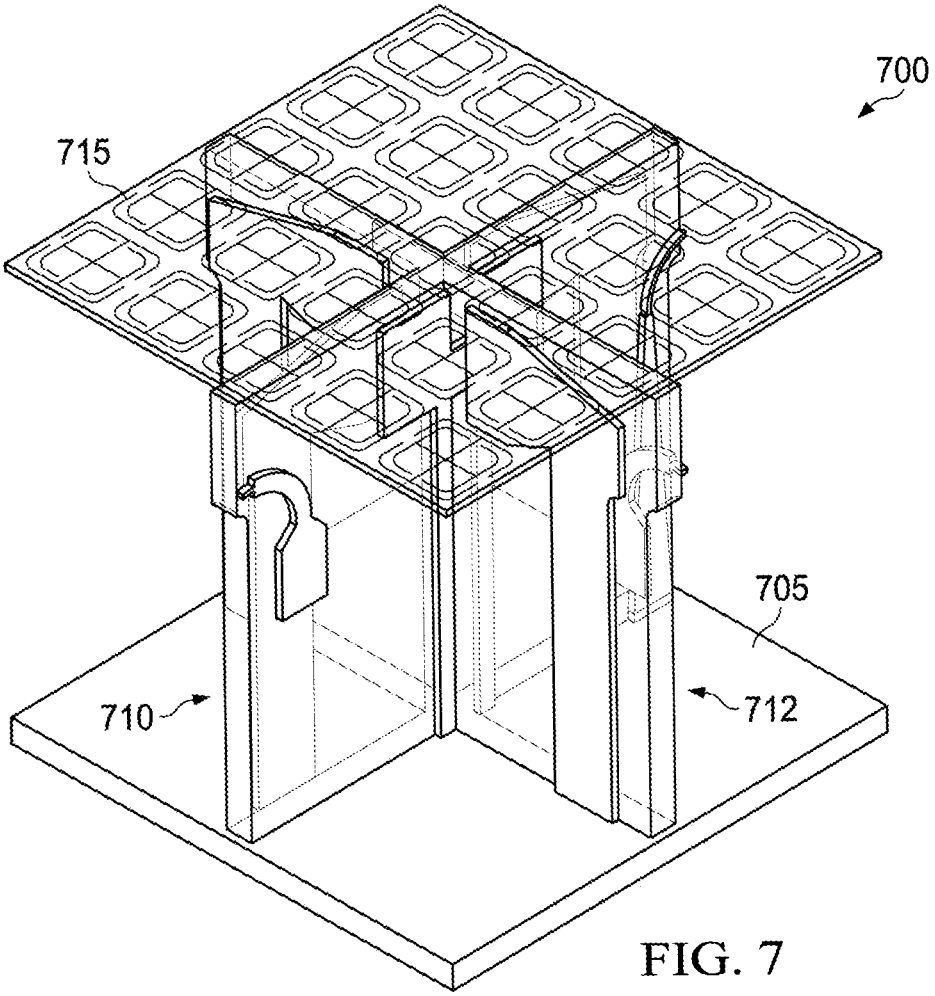
FIG. 7 illustrates an isometric view of a portion of a dual polarization antenna array according to example embodiments presented herein.

FIG. 7 illustrates an isometric view of a portion of a dual polarization antenna array 700. The isometric view of the portion of the dual polarization antenna array 700 displays parts of single layer substrate antennas 710 arranged in a plurality of first parallel planes and parts of single layer substrate antennas 712 arranged in a plurality of second parallel planes. The parts of single layer substrate antennas 710 and parts of single layer substrate antennas 712 are disposed on a ground plane 705, with a top surface 715 disposed thereon. Top surface 715 may be a dielectric superstrate or a metasurface, for example. In an embodiment, the first parallel planes and the second parallel planes are orthogonal planes arranged in a diagonal layout. The diagonal layout helps to stabilize scanning performance.

In an embodiment, a height of the dual polarization antenna array is less than one-half of the wavelength of the highest operating frequency. As an example, the height of the dual polarization antenna array is approximately 0.4 times the wavelength of the highest operating frequency. Other values are possible. In another embodiment, the height does not include the top surface.

In another embodiment, the lateral dimension of each single substrate antenna element in the dual polarization antenna array is approximately one-half of the wavelength of the highest operating frequency. As an example, the lateral dimension of each single substrate antenna element in the dual polarization antenna array is approximately 0.5 times the wavelength of the highest operating frequency. Other values are possible. As an example, the lateral dimension of each single substrate antenna element in the dual polarization antenna array is approximately 0.5 (but less than 0.53) times the wavelength of the highest operating frequency. Other values are possible.

In an embodiment, the single layer substrate antenna (as shown in FIG. 4) and the antenna arrays formed from the single layer substrate antenna (as shown in FIGS. 6A, 6B, and 7) are monolithically fabricated. The single layer substrate antenna and the antenna arrays formed from the single layer substrate antenna may be formed using a three-dimensional (3D) printing or additive manufacturing techniques, for example. In 3D printing, including vat photopolymerization, powder bed fusion, material extrusion, sheet lamination, directed energy deposition, material jetting, and binder jetting methods, the parts and structures are formed layer by layer. 3D printing allows for the formation of complex geometric shapes that can be mass customized, because no die or mold is required and design concepts are translated into products through direct digital manufacturing. Furthermore, the additively layered approach enables the merging of multiple components into a single piece, which removes the requirement for subsequent assembly operations.

Figure 8A:
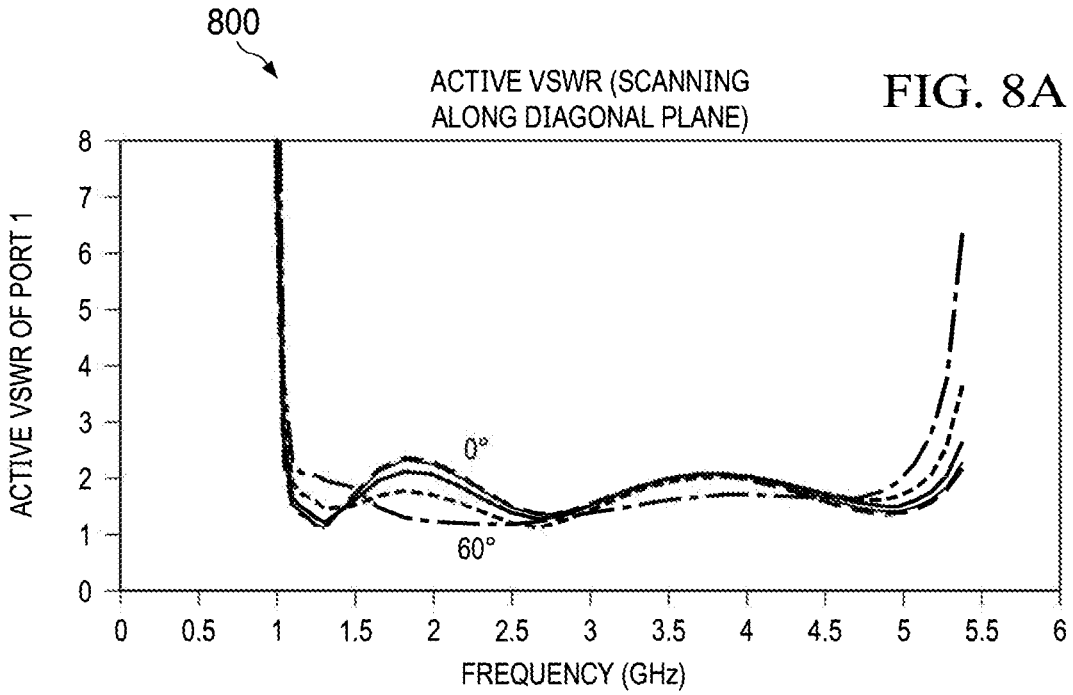
FIG. 8A illustrates a data plot of VSWR for a first signal with a first polarization when a second signal with a second polarization is active for a dual polarization antenna array comprising a plurality of single layer substrate antennas, where the coupling capacitances of the single layer substrate antennas arranged in the first parallel planes are shorted to the ground plane by the posts according to example embodiments presented herein.

FIG. 8A illustrates a data plot Boo of VSWR for a first signal with a first polarization when a second signal with a second polarization is active for a dual polarization antenna array comprising a plurality of single layer substrate antennas, where the coupling capacitances of the single layer substrate antennas arranged in the first parallel planes are shorted to the ground plane by the posts. Data plot 800 displays the VSWR for the first signal with angles ranging from −60 to +60 degrees with scanning being performed along a diagonal plane, showing that the VSWR remains relatively flat from approximately 1.1 GHz to 5.2 GHz for the entirety of the angle range.

Figure 8B:
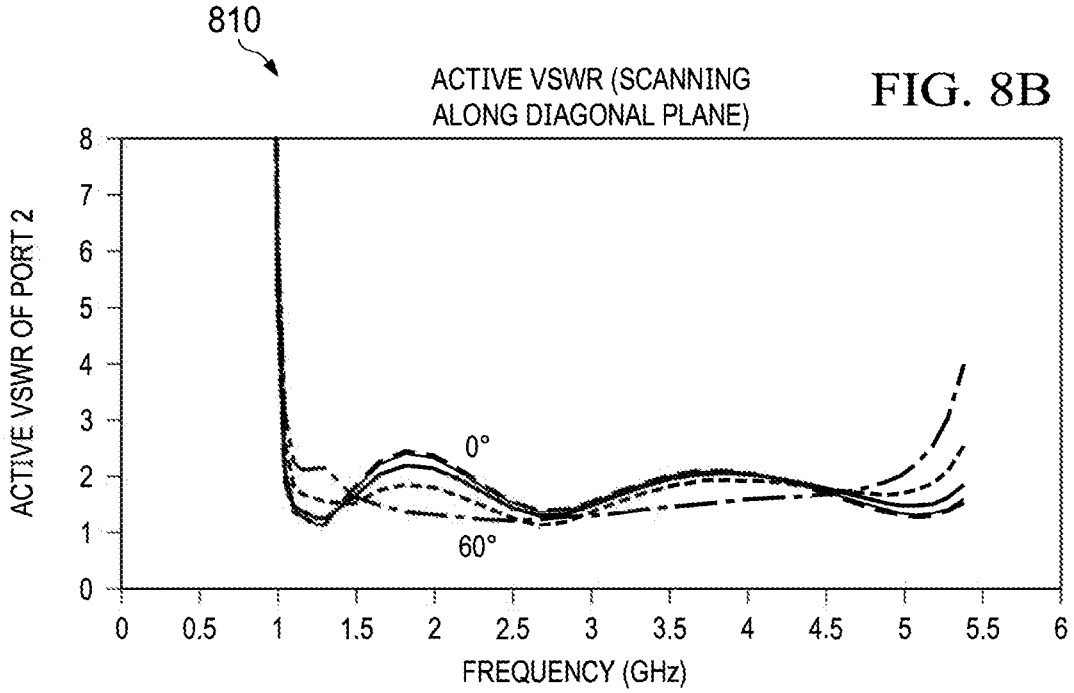
FIG. 8B illustrates a data plot of VSWR for the second signal with the second polarization when the first signal with the first polarization is active for a dual polarization antenna array comprising a plurality of single layer substrate antennas, where the coupling capacitances of the single layer substrate antennas arranged in the second parallel planes are not shorted to the ground plane by the posts according to example embodiments presented herein.

FIG. 8B illustrates a data plot 810 of VSWR for the second signal with the second polarization when the first signal with the first polarization is active for a dual polarization antenna array comprising a plurality of single layer substrate antennas, where the coupling capacitances of the single layer substrate antennas arranged in the second parallel planes are not shorted to the ground plane by the posts. Data plot 810 displays the VSWR for the first signal with angles ranging from −60 to +60 degrees with scanning being performed along a diagonal plane, showing that the VSWR remains relatively flat from approximately 1.1 GHz to 5.3 GHz for the entirety of the angle range.

Figure 8C:
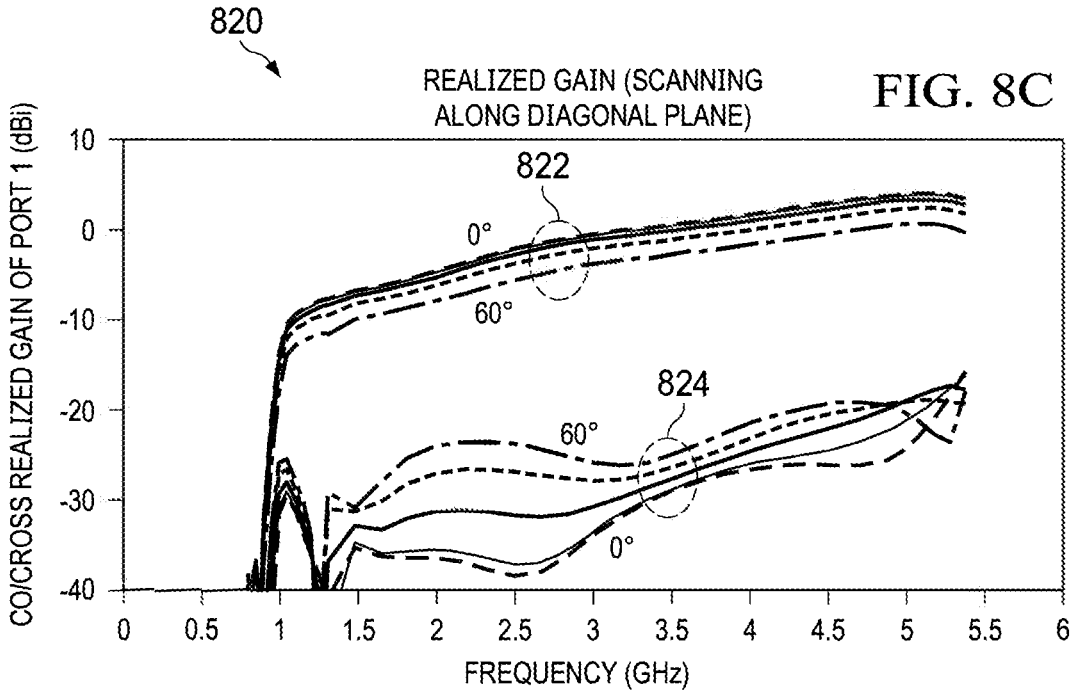
FIG. 8C illustrates a data plot of co-realized and cross-realized gain for the first signal with the first polarization when the second signal with the second polarization is inactive for a dual polarization antenna array comprising a plurality of single layer substrate antennas, where the coupling capacitances of the single layer substrate antennas arranged in the first parallel planes are shorted to the ground plane by the posts according to example embodiments presented herein.

FIG. 8C illustrates a data plot 820 of co-realized and cross-realized gain for the first signal with the first polarization when the second signal with the second polarization is inactive for a dual polarization antenna array comprising a plurality of single layer substrate antennas, where the coupling capacitances of the single layer substrate antennas arranged in the first parallel planes are shorted to the ground plane by the posts. As shown in FIG. 8C, a first set of curves 822 represents co-realized gain for angles −60 to +60 degrees with scanning being performed along a diagonal plane, while a second set of curves 824 represents cross-realized gain for angles −60 to +60 degrees with scanning being performed along a diagonal plane. Cross-realized gain ranges from 20 to 30 dB less than co-realized gain over the frequency range.

Figure 8D:
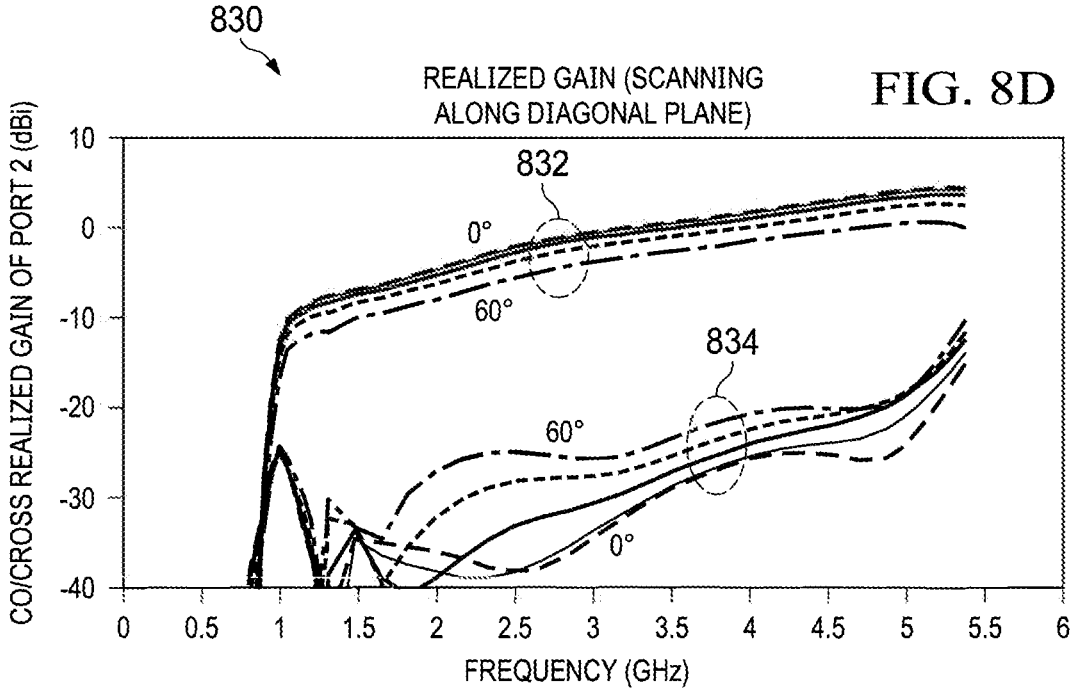
FIG. 8D illustrates a data plot of co-realized and cross-realized gain for the second signal with the second polarization when the first signal with the first polarization is inactive for a dual polarization antenna array comprising a plurality of single layer substrate antennas, where the coupling capacitances of the single layer substrate antennas arranged in the first parallel planes are not shorted to the ground plane by the posts according to example embodiments presented herein.

FIG. 8D illustrates a data plot 830 of co-realized and cross-realized gain for the second signal with the second polarization when the first signal with the first polarization is inactive for a dual polarization antenna array comprising a plurality of single layer substrate antennas, where the coupling capacitances of the single layer substrate antennas arranged in the first parallel planes are not shorted to the ground plane by the posts. As shown in FIG. 8D, a first set of curves 832 represents co-realized gain for angles −60 to +60 degrees with scanning being performed along a diagonal plane, while a second set of curves 834 represents cross-realized gain for angles −60 to +60 degrees with scanning being performed along a diagonal plane. Cross-realized gain ranges from 20 to 25 dB less than co-realized gain over the frequency range.

Figure 9A:
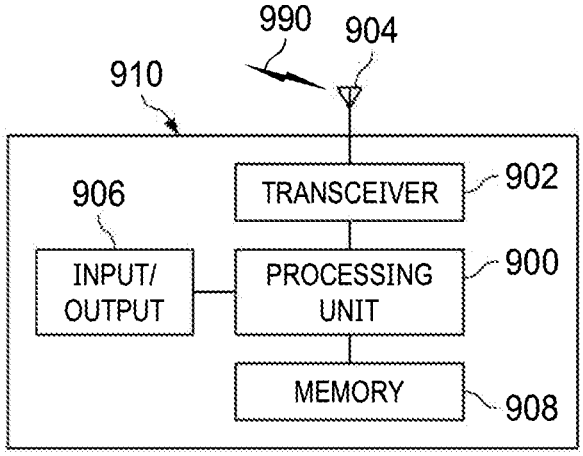
FIGS. 9A and 9B illustrate example devices that may implement the methods and teachings according to this disclosure.
Figure 9B:
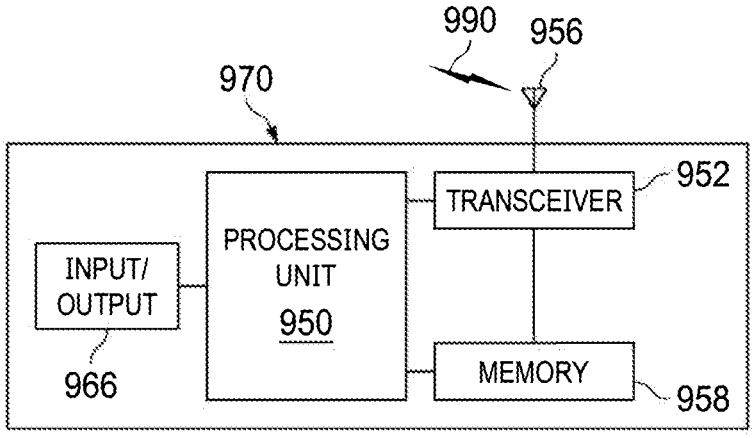

FIGS. 9A and 9B illustrate example devices that may implement the methods and teachings according to this disclosure. In particular, FIG. 9A illustrates an example electronic device (ED) 910, and FIG. 9B illustrates an example base station 970. These components could be used in a system.

As shown in FIG. 9A, the ED 910 includes at least one processing unit 900. The processing unit 900 implements various processing operations of the ED 910. For example, the processing unit 900 could perform signal coding, data processing, power control, input/output processing, or any other functionality enabling the ED 910 to operate in the system. The processing unit 900 also supports the methods and teachings described in more detail above. Each processing unit 900 includes any suitable processing or computing device configured to perform one or more operations. Each processing unit 900 could, for example, include a microprocessor, microcontroller, digital signal processor, field programmable gate array, or application specific integrated circuit.

The ED 910 also includes at least one transceiver 902. The transceiver 902 is configured to modulate data or other content for transmission by at least one antenna or NIC (Network Interface Controller) 904. The at least one antenna 904 may be a single layer substrate antenna or an antenna array comprised of single layer substrate antennas, as described herein. The transceiver 902 is also configured to demodulate data or other content received by the at least one antenna 904. Each transceiver 902 includes any suitable structure for generating signals for wireless or wired transmission or processing signals received wirelessly or by wire. Each antenna 904 includes any suitable structure for transmitting or receiving wireless or wired signals. One or multiple transceivers 902 could be used in the ED 910, and one or multiple antennas 904 could be used in the ED 910. Although shown as a single functional unit, a transceiver 902 could also be implemented using at least one transmitter and at least one separate receiver.

The ED 910 further includes one or more input/output devices 906 or interfaces (such as a wired interface to the Internet). The input/output devices 906 facilitate interaction with a user or other devices (network communications) in the network. Each input/output device 906 includes any suitable structure for providing information to or receiving information from a user, such as a speaker, microphone, keypad, keyboard, display, or touch screen, including network interface communications.

In addition, the ED 910 includes at least one memory 908. The memory 908 stores instructions and data used, generated, or collected by the ED 910. For example, the memory 908 could store software or firmware instructions executed by the processing unit(s) 900 and data used to reduce or eliminate interference in incoming signals. Each memory 908 includes any suitable volatile or non-volatile storage and retrieval device(s). Any suitable type of memory may be used, such as random access memory (RAM), read only memory (ROM), hard disk, optical disc, subscriber identity module (SIM) card, memory stick, secure digital (SD) memory card, and the like.

As shown in FIG. 9B, the base station 970 includes at least one processing unit 950, at least one transceiver 952, which includes functionality for a transmitter and a receiver, one or more antennas 956, at least one memory 958, and one or more input/output devices or interfaces 966. The at least one antenna 956 may be a single layer substrate antenna or an antenna array comprised of single layer substrate antennas, as described herein. A scheduler, which would be understood by one skilled in the art, is coupled to the processing unit 950. The scheduler could be included within or operated separately from the base station 970. The processing unit 950 implements various processing operations of the base station 970, such as signal coding, data processing, power control, input/output processing, or any other functionality. The processing unit 950 can also support the methods and teachings described in more detail above. Each processing unit 950 includes any suitable processing or computing device configured to perform one or more operations. Each processing unit 950 could, for example, include a microprocessor, microcontroller, digital signal processor, field programmable gate array, or application specific integrated circuit.

Each transceiver 952 includes any suitable structure for generating signals for wireless or wired transmission to one or more EDs or other devices. Each transceiver 952 further includes any suitable structure for processing signals received wirelessly or by wire from one or more EDs or other devices. Although shown combined as a transceiver 952, a transmitter and a receiver could be separate components. Each antenna 956 includes any suitable structure for transmitting or receiving wireless or wired signals. While a common antenna 956 is shown here as being coupled to the transceiver 952, one or more antennas 956 could be coupled to the transceiver(s) 952, allowing separate antennas 956 to be coupled to the transmitter and the receiver if equipped as separate components. Each memory 958 includes any suitable volatile or non-volatile storage and retrieval device(s). Each input/output device 966 facilitates interaction with a user or other devices (network communications) in the network. Each input/output device 966 includes any suitable structure for providing information to or receiving/providing information from a user, including network interface communications.

Although the present disclosure and its advantages have been described in detail, it should be understood that various changes, substitutions and alterations can be made herein without departing from the spirit and scope of the disclosure as defined by the appended claims.

What is claimed is:

1. A modular wideband antenna comprising:

a ground plane;

a first antenna element and a second antenna element disposed on a first surface of a substrate;

a first portion of a two-layer feed balun disposed on the first surface of the substrate, the first portion of the two-layer feed balun being electrically coupled to the first and second antenna elements, and the first portion of the two-layer feed balun being electrically coupled to the ground plane;

a second portion of the two-layer feed balun disposed on a second surface of the substrate, the second portion of the two-layer feed balun being electrically coupled to a signal feed, and the second portion of the two-layer feed balun being capacitively coupled to the first portion of the two-layer feed balun;

a first coupling capacitance and a second coupling capacitance disposed on the second surface of the substrate, the first coupling capacitance being capacitively coupled to the first antenna element, and the second coupling capacitance being capacitively coupled to the second antenna element; and a first grounding post and a second grounding post, the first grounding post being electrically coupled to the first coupling capacitance and the ground plane, the second grounding post being electrically coupled to the second coupling capacitance and the ground plane.

2. The modular wideband antenna of claim 1, wherein the first portion of the two-layer feed balun comprises a first conductor and a second conductor, the first conductor being electrically coupled to the first antenna element and the ground plane, and the second conductor being electrically coupled to the second antenna element and the ground plane.

3. The modular wideband antenna of claim 2, wherein the first conductor and the second conductor are separated by a gap.

4. The modular wideband antenna of claim 2, wherein the first conductor and the second conductor are of substantially constant width.

5. The modular wideband antenna of claim 2, wherein the first conductor and the second conductor are of substantially equal width.

6. The modular wideband antenna of claim 1, wherein the second portion of the two-layer feed balun comprises:

a tapered first portion electrically coupled to the signal feed;

a curved second portion electrically coupled to the tapered first portion;

a curved third portion electrically coupled to the curved second portion; and a rectangular fourth portion electrically coupled to the curved third portion.

7. The modular wideband antenna of claim 1, wherein the first portion of the two-layer feed balun, the first antenna element, and the second antenna element comprise a first metallization layer.

8. The modular wideband antenna of claim 1, wherein the second portion of the two-layer feed balun, the first coupling capacitance, and the second coupling capacitance comprise a second metallization layer.

9. The modular wideband antenna of claim 8, wherein the second metallization layer further comprises the first grounding post and the second grounding post.

10. The modular wideband antenna of claim 1, wherein the substrate is a single layer substrate.

11. An antenna array comprising:

a ground plane; and a plurality of modular wideband antennas, each modular wideband antenna comprising, a first antenna element and a second antenna element disposed on a first surface of a substrate, a first portion of a two-layer feed balun disposed on the first surface of the substrate, the first portion of the two-layer feed balun being electrically coupled to the first and second antenna elements, and the first portion of the two-layer feed balun being electrically coupled to the ground plane, a second portion of the two-layer feed balun disposed on a second surface of the substrate, the second portion of the two-layer feed balun being electrically coupled to a signal feed, and the second portion of the two-layer feed balun being capacitively coupled to the first portion of the two-layer feed balun, and a first coupling capacitance and a second coupling capacitance disposed on the second surface of the substrate, the first coupling capacitance being capacitively coupled to the first antenna element, and the second coupling capacitance being capacitively coupled to the second antenna element.

12. The antenna array of claim 11, wherein each modular wideband antenna further comprises a first grounding post and a second grounding post, the first grounding post being electrically coupled to the first coupling capacitance and the ground plane, the second grounding post being electrically coupled to the second coupling capacitance and the ground plane.

13. The antenna array of claim 11, wherein the antenna array comprises a single polarized array, and the first antenna element and the second antenna element are arranged in a plurality of parallel planes.

14. The antenna array of claim 11, wherein the antenna array comprises a dual polarized array, first antenna elements and second antenna elements of a first subset of a plurality of modular wideband antenna elements are arranged in a plurality of first parallel planes, and first antenna elements and second antenna elements of a second subset of the plurality of modular wideband antenna elements are arranged in a plurality of second parallel planes.

15. The antenna array of claim 14, wherein the first parallel planes and the second parallel planes are orthogonal.

16. The antenna array of claim 14, wherein first grounding posts of the first subset of the plurality of modular wideband antenna elements are electrically coupled to second grounding posts of the first subset of the plurality of modular wideband antenna elements, and first grounding posts of the second subset of the plurality of modular wideband antenna elements are electrically coupled to second grounding posts of the second subset of the plurality of modular wideband antenna elements.

17. The antenna array of claim 16, wherein the first grounding posts and the second grounding posts of the first subset of the plurality of modular wideband antenna elements are electrically coupled to the first grounding posts and the second grounding posts of the second subset of the plurality of modular wideband antenna elements.

18. The antenna array of claim 16, wherein the first grounding posts and the second grounding posts of the first subset of the plurality of modular wideband antenna elements are electrically decoupled from the first grounding posts and the second the of the second subset of the plurality of modular wideband antenna elements.

19. The antenna array of claim 11, wherein the substrate is a single layer substrate.

20. The antenna array of claim 11, further comprising a metasurface or a superstrate disposed over a plurality of modular wideband antenna elements.

21. The antenna array of claim 11, wherein orientations of substrates of the plurality of modular wideband antennas are diagonal to an orientation of the antenna array.

22. The antenna array of claim 11, wherein the antenna array is fabricated using a three-dimensional printing process.

* * * * *